US008801154B2

(12) United States Patent
Watanabe et al.

(10) Patent No.: US 8,801,154 B2
(45) Date of Patent: Aug. 12, 2014

(54) LIQUID EJECTION HEAD AND LIQUID EJECTION APPARATUS

(71) Applicant: Seiko Epson Corporation, Tokyo (JP)

(72) Inventors: Shunsuke Watanabe, Matsumoto (JP); Hiroaki Okui, Azumino (JP); Katsumi Enomoto, Matsumoto (JP); Yuma Fukuzawa, Matsumoto (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 13/750,140

(22) Filed: Jan. 25, 2013

(65) Prior Publication Data

US 2013/0194352 A1 Aug. 1, 2013

(30) Foreign Application Priority Data

Jan. 27, 2012 (JP) ..... 2012-014753

(51) Int. Cl.
*B41J 2/045* (2006.01)

(52) U.S. Cl.
USPC ..... 347/71; 347/68

(58) Field of Classification Search
CPC ..... B41J 2/14201; B41J 2002/14362
See application file for complete search history.

(56) References Cited

U.S. PATENT DOCUMENTS

2012/0236082 A1* 9/2012 Akahane ..... 347/68
2013/0127956 A1* 5/2013 Watanabe et al. ..... 347/71

FOREIGN PATENT DOCUMENTS

JP 2005-219243 8/2005

* cited by examiner

*Primary Examiner* — Lisa M Solomon
(74) *Attorney, Agent, or Firm* — Harness, Dickey & Pierce, P.L.C.

(57) ABSTRACT

A liquid ejection head includes a communication plate in which a first liquid chamber that communicate with a plurality of pressure chambers is formed, wherein a plurality of the first liquid chambers separated from each other are provided in the first direction and the first liquid chamber communicates with the pressure chamber through an opening in the thickness direction of the communication plate.

3 Claims, 7 Drawing Sheets

LIQUID EJECTION HEAD AND LIQUID EJECTION APPARATUS

CROSS REFERENCES TO RELATED APPLICATIONS

The entire disclosure of Japanese Patent Application No. 2012-014753, filed Jan. 27, 2012 is incorporated by reference herein.

BACKGROUND

1. Technical Field

The present invention relates to a liquid ejection head such as an ink jet recording head and a liquid ejection apparatus having the same, and more specifically to a liquid ejection head including a nozzle forming member having a plurality of nozzles that are arranged in rows, a pressure generating unit having a pressure generating section that generates pressure changes in a pressure chamber, a communication member in which a liquid chamber cavity that serves as part of a common liquid chamber and a supply communication path that communicates the liquid chamber cavity with the pressure chamber are formed, and a case member which is fixedly attached to the communication member on which the nozzle forming member and the pressure generating unit are bonded, and a liquid ejection apparatus having the same.

2. Related Art

Liquid ejection apparatuses generally have a liquid ejection head and eject various liquid from the ejection head. Such liquid ejection apparatuses include, for example, image recording apparatuses such as an ink jet printer and an ink jet plotter. Recently, liquid ejection apparatuses are applied to a variety of manufacturing apparatuses, taking advantage of their capability of precisely ejecting an extremely small amount of liquid onto a target position. For example, liquid ejection apparatuses are applied to display manufacturing apparatuses for manufacturing color filters for liquid crystal displays, electrode manufacturing apparatuses for manufacturing electrodes of organic electroluminescence (EL) displays or field emission displays (FEDs), and chip manufacturing apparatuses for manufacturing biochips. The recording head for image recording apparatuses ejects ink in a liquid form, and the color material ejection head for display manufacturing apparatuses ejects the respective color material solution of R (red), G (green) and B (blue). Further, the electrode material ejection head for electrode manufacturing apparatuses ejects an electrode material in a liquid form, and the bio-organic material ejection head for chip manufacturing apparatuses ejects a bio-organic solution.

JP-A-2005-219243 discloses an example of liquid ejection head of the above-mentioned type, which includes a nozzle plate having a plurality of nozzles, a flow path forming substrate in which an individual flow path having pressure chambers that communicate with the respective nozzles and a cavity that serves as part of a common liquid chamber (also referred to as a reservoir or manifold) for storing liquid commonly used for the respective pressure chambers are formed, a plurality of piezoelectric elements (a type of pressure generating section) that correspond to the respective pressure chambers, and a common liquid chamber forming substrate in which a common liquid chamber cavity that serves as a common liquid chamber for storing liquid commonly used for the respective pressure chambers is formed.

In the above-mentioned flow path forming substrate, a configuration is also proposed in which the cavity that serves as part of a common liquid chamber is not provided, thereby reducing the size of the flow path forming substrate. FIGS. 7A and 7B are schematic views which show an example of a configuration in which the flow path forming substrate is downsized. FIG. 7A is an essential sectional view, and FIG. 7B is an essential plan view. The direction perpendicular to the sheet of FIG. 7A is a nozzle row direction, and the up-down direction in FIG. 7B is the nozzle row direction. In this example, reference numeral 55 denotes a flow path forming substrate in which a pressure chamber 56 is formed, reference numeral 57 denotes a nozzle plate having a nozzle 58, reference numeral 59 denotes a communication substrate in which a nozzle communication path 60 that communicate the pressure chamber 56 with the nozzle 58 is formed, and reference numeral 64 denotes an actuator unit having a piezoelectric element 62. Those components are stacked to form a head body 54.

In the above configuration, for example, in the case where a plurality of common liquid chambers 61 are independently provided, that is, one common liquid chamber that corresponds to one nozzle row is divided into a plurality of common liquid chambers 61, the adjacent common liquid chambers 61 are separated by a section wall 66 and the side end face of the section wall 66 needs to be bonded to the side face of the head body 54 by using an adhesive (an area X shown in FIG. 7B). However, this has a problem in that ink in the adjacent common liquid chambers 61 is leaked out from the connection portion.

SUMMARY

An advantage of some aspects of the invention is that a liquid ejection head having a configuration in which a plurality of common liquid chambers are provided for a nozzle row that is capable of preventing liquid in the common liquid chambers from being leaked out and also reducing the cost, and a liquid ejection apparatus having the same are provided.

According to an aspect of the invention, a liquid ejection head includes a nozzle forming member having a group of nozzles composed of a plurality of nozzles that are arranged in rows in a first direction; a pressure generating unit having a pressure chamber forming substrate in which a plurality of pressure chambers that correspond to the plurality of nozzles are formed, a plurality of pressure generating sections that are formed to correspond to the pressure chambers, and a protective substrate that is connected to the pressure chamber forming substrate with the pressure generating sections being housed therein; a communication plate in which a first liquid chamber that communicate with the plurality of pressure chambers is formed; and a case member to which the pressure generating unit and the communication plate are fixedly attached, wherein a plurality of the first liquid chambers separated from each other are provided in the first direction and the first liquid chamber communicates with the pressure chamber through an opening in the thickness direction of the communication plate.

Accordingly, it is possible to form a plurality of common liquid chambers independent from each other only by bonding the top face of the communication forming member and the underside of the case member without bonding the side face of the wall that separates the common liquid chambers adjacent in the first direction to the side face of the pressure generating unit. As a result, even in the configuration in which a plurality of common liquid chambers are provided for one group of nozzles in the nozzle row direction, it is possible to prevent liquid from being leaked from a position between the common liquid chambers.

In the above aspect of the invention, it is preferable that the case member has a housing cavity that houses the pressure generating unit and a second liquid chamber that communicates with the first liquid chamber, an opening of the first liquid chamber on the side of the case member faces part of the case member and part of the pressure chamber of the pressure generating unit, and the case member and the pressure generating unit at the housing cavity are at least partially bonded to each other.

Further, in the above aspect of the invention, it is preferable that a gap between the case member and the pressure generating unit in the opening of the first liquid chamber on the side of the case member is sealed by using an adhesive.

According to another aspect of the invention, a liquid ejection apparatus includes the liquid ejection head according to the above aspect.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments for implementing the invention will be described below with reference to the accompanying drawings. Although various limitations are described in the following embodiments as preferred examples of the invention, the scope of the invention is not limited to these embodiments unless otherwise specifically stated herein. In the following description, an ink jet printer (a type of liquid ejection apparatus according to the invention) will be described as an example of liquid ejection apparatus of the invention.

Figure 1:
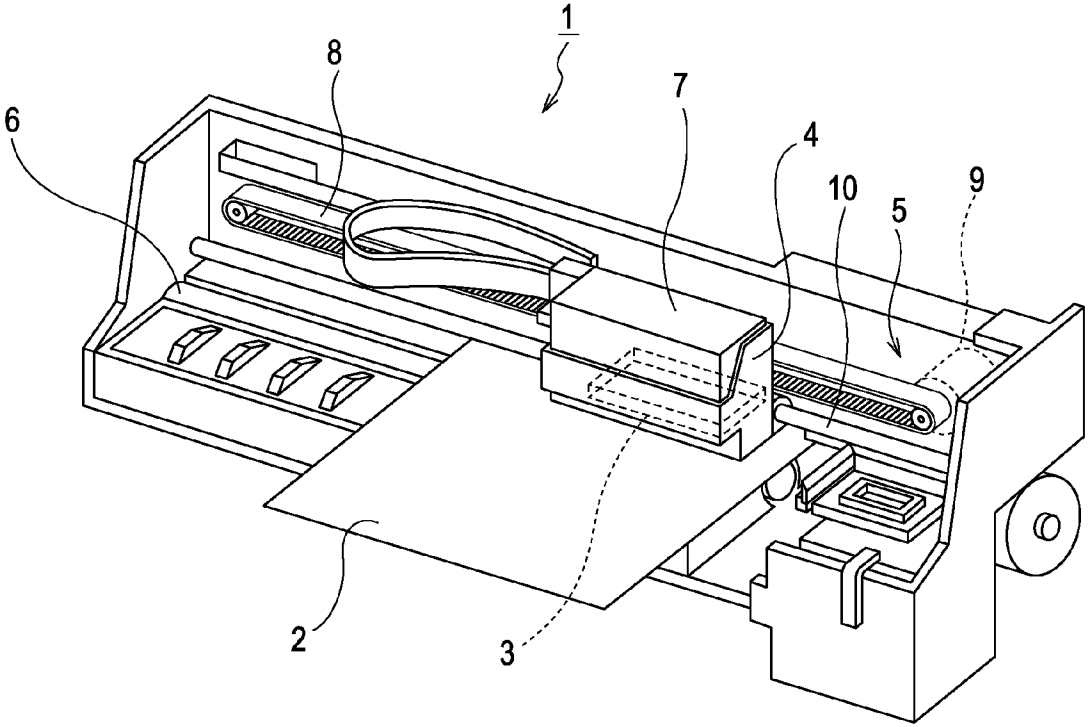
FIG. 1 is a perspective view which explains a configuration of a printer.

A configuration of a printer 1 will be described with reference to FIG. 1. The printer 1 is an apparatus that performs recording of images and the like by ejecting ink in a liquid form onto a surface of a recording medium 2 such as a recording sheet (a type of ejection target). The printer 1 includes a recording head 3 that ejects ink, a carriage 4 on which the recording head 3 is mounted, a carriage movement mechanism 5 that moves the carriage 4 in a main scan direction, a platen roller 6 that transports the recording medium 2 in a sub-scan direction. The above-mentioned ink is a type of liquid according to the invention and is stored in an ink cartridge 7 which is a liquid supply source. The ink cartridge 7 is detachably mounted on the recording head 3. Alternatively, the ink cartridge 7 may be disposed in the main body of the printer 1 or outside of the main body of the printer 1 so that ink is supplied from the ink cartridge 7 via an ink supplying tube to the recording head 3.

The carriage movement mechanism 5 includes a timing belt 8. The timing belt 8 is driven by a pulse motor 9 such as a DC motor. Accordingly, when the pulse motor 9 actuates, the carriage 4 is guided on a guide rod 10 that is disposed in the printer 1 and reciprocates in the main scan direction (the width direction of the recording medium 2).

Figure 2:
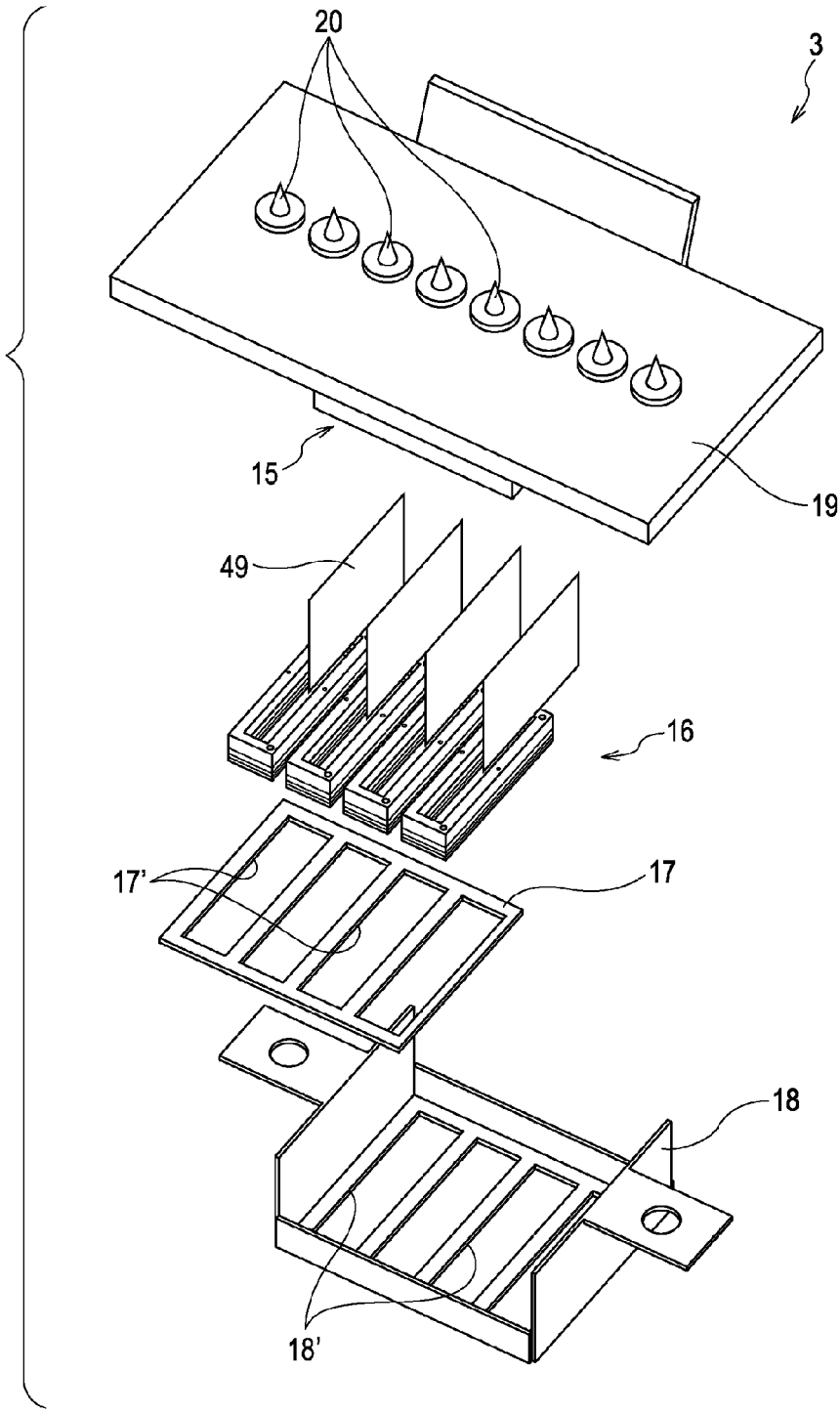
FIG. 2 is an exploded perspective view of a recording head as viewed from obliquely above.

FIG. 2 is an exploded perspective view which shows a configuration of the recording head 3. The recording head according to this embodiment is generally composed of a case 15, a plurality of head units 16, a unit fixation plate 17 and a head cover 18. The case 15 is a box-shaped member including the plurality of head units 16, a supply flow path (not shown in the figure) through which ink is supplied to the head units 16 and the like, with a needle holder 19 being formed on the top face thereof. The needle holder 19 is provided with ink introduction needles 20 disposed thereon, and in this embodiment, eight ink introduction needles 20 which correspond to the respective colors of ink of the ink cartridge 7 are arranged side by side on the needle holder 19. Each ink introduction needle 20 is formed as a hollow needle that is inserted into the ink cartridge 7 such that ink stored in the ink cartridge 7 is introduced via the supply flow path in the case 15 to the head units 16 through an introduction hole (not shown in the figure) formed at the tip of the ink introduction needle 20.

On the bottom side of the case 15, four head units which are positioned side by side in the main scan direction are mounted on a unit fixation plate 17 that is made of a metal and has four openings 17' which correspond to the respective head units 16. Further, the head units 16 are fixedly attached by a head cover 18 that is made of a metal and has four openings 18' which correspond to the respective head units 16.

Figure 3:
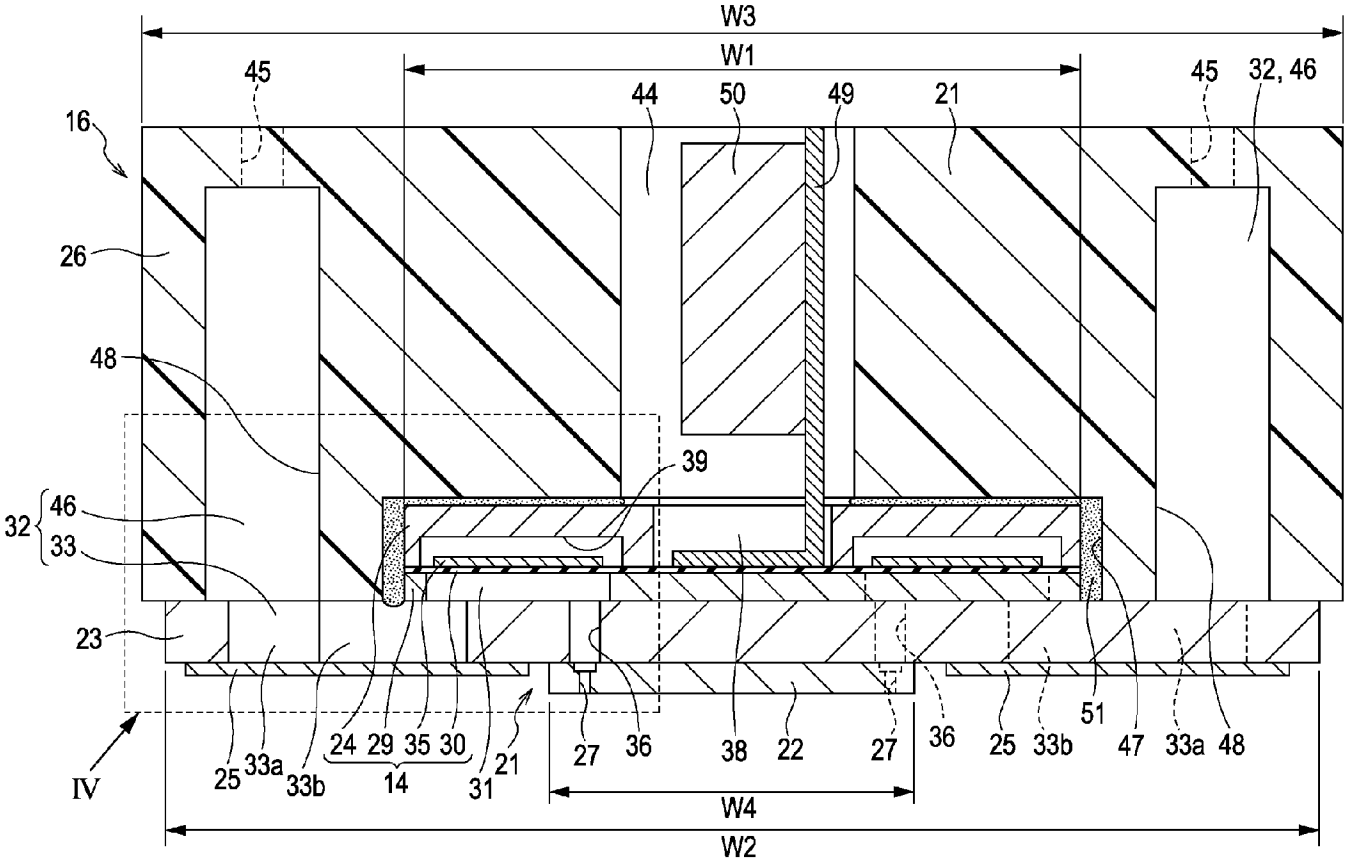
FIG. 3 is a sectional view of a head unit.
Figure 4:
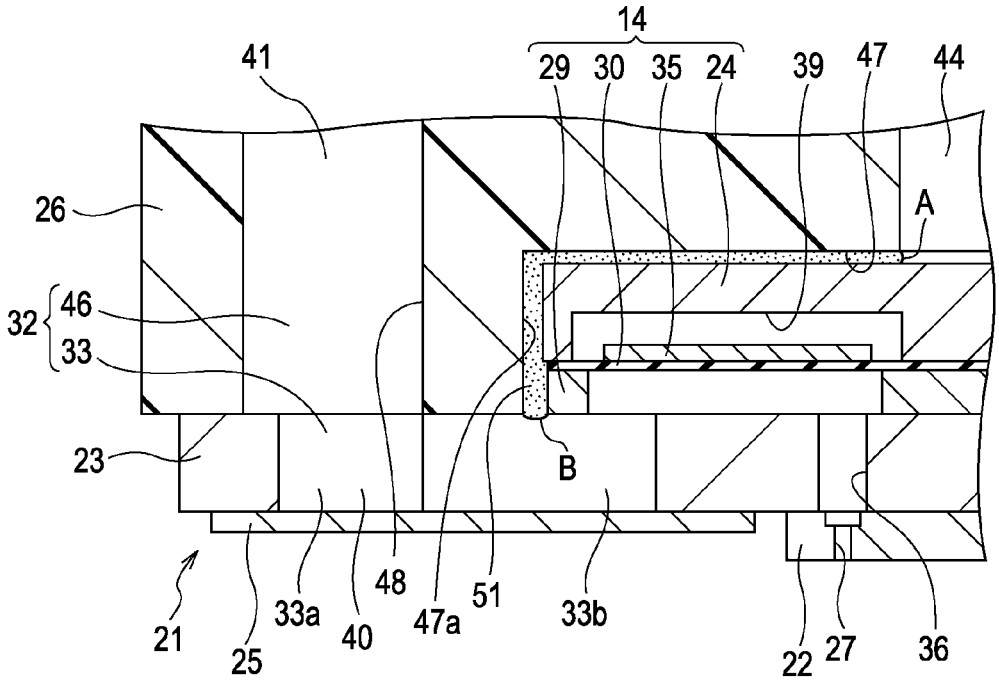
FIG. 4 is an enlarged sectional view of an area IV of FIG. 3.

FIG. 3 is a sectional view which shows an internal configuration of the head unit 16 (a type of liquid ejection head according to the invention). FIG. 4 is an enlarged view of an area IV of FIG. 3. For convenience of description, a direction in which the components are stacked is referred to as up-down direction. The head unit 16 of this embodiment includes a pressure generating unit 14 and a flow path unit 21, and is fixedly attached to a case head 26 (which corresponds to a case member of the invention) with the pressure generating unit 14 and the flow path unit 21 being stacked. The flow path unit 21 includes a nozzle plate 22 (a type of nozzle forming member), a communication substrate 23 (a type of communication plate) and a compliance sheet 25 (a type of compliance member). The pressure generating unit 14 is a unit formed of the stack of a pressure chamber forming substrate 29 in which pressure chambers 31 are formed, an elastic film 30, a piezoelectric element 35 (pressure generating section) and a protective substrate 24.

The pressure chamber forming substrate 29 which is a component of the pressure generating unit 14 is made of a silicon single crystal substrate (a type of crystalline substrate; hereinafter also simply referred to as silicon substrate). A plurality of pressure chambers 31 which correspond to the respective nozzles 27 of the nozzle plate 22 are formed in the pressure chamber forming substrate 29 by anisotropic etching of the silicon substrate. Although the substrate may be made of other material such as a ceramic and a metal, the pressure chambers formed by anisotropic etching of the silicon substrate can increase dimensional and geometrical accuracy. As described later, since two rows of nozzles 27 are formed on the nozzle plate 22 in this embodiment, two rows of pressure chambers 31 are formed in the pressure chamber forming substrate 29 so as to correspond to the respective rows of nozzles. The pressure chamber 31 is an elongated cavity which extends in a direction (second direction) perpendicular to an arrangement direction of the nozzles 27 (first direction). When the pressure chamber forming substrate 29 (pressure generating unit 14) is positioned and bonded on the communication substrate 23, which will be described later, one end of the pressure chamber 31 in the second direction communicates with the nozzle 27 via a nozzle communication path 36 of the communication substrate 23, which will be described later. The other end of the pressure chamber 31 in the second direction communicates with a common liquid chamber 32 (a liquid chamber cavity 33) via a second communication section 33*b* of the communication substrate 23, which will be described later.

The elastic film 30 is disposed on the top face of the pressure chamber forming substrate 29 (the surface opposite to the surface attached to the communication substrate 23) so as to seal an upper opening of the pressure chamber 31. The elastic film 30 is made of, for example, silicon dioxide having a thickness of approximately 1 μm. Further, an insulation film (not shown in the figure) is disposed on the elastic film 30. The insulation film is made of, for example, zirconium oxide. The piezoelectric elements 35 are disposed on the elastic film 30 and the insulation film at positions which correspond to the pressure chambers 31. The piezoelectric element 35 is a so-called flexural mode piezoelectric element. The piezoelectric elements 35 are formed by laminating in sequence a lower electrode film made of a metal, a piezoelectric layer made of a lead zirconate titanate (PZT) and the like, and an upper electrode film made of a metal (all of which are not shown in the figure) on the elastic film 30 and the insulation film, and then performing patterning in each of the pressure chambers 31. One of the upper electrode film and the lower electrode film serves as a common electrode, while the other serves as an individual electrode. When driving the piezoelectric elements 35, the elastic film 30, the insulation film and the lower electrode film serve as a vibration plate.

Electrode wirings (not shown in the figure) which extend from the respective individual electrodes (upper electrode film) of the piezoelectric elements 35 are disposed on the insulation film and a portion of the electrode wirings which corresponds to the electrode terminal is connected to a terminal of one end of a flexible cable 49. The flexible cable 49 is, for example, formed by providing a conductive pattern of a copper foil on the surface of a base film made of polyimide and the like, and then covering the conductive pattern with a resist. A drive IC 50 that drives the piezoelectric elements 35 is mounted on the surface of the flexible cable 49. The respective piezoelectric elements 35 are flexibly deformed when a drive signal (drive voltage) is applied between the upper electrode film and the lower electrode film via the drive IC 50, and serve as a pressure generating section that generates pressure in the pressure chambers 31 by deformation of the vibration plate. As a matter of course, piezoelectric elements and heat generating elements that perform any other deformation may be used as a pressure generating section.

The protective substrate 24 is provided on the top face of the communication substrate 23 on which the piezoelectric elements 35 are disposed. The protective substrate 24 is a hollow box-shaped member having an opening on the bottom side, and made of, for example, glass, ceramic, silicon single crystal substrate, metal, synthetic resin, etc. A relief recess 39 that is sized not to interfere the driving of the piezoelectric element 35 is formed in the protective substrate 24 at a position that faces the piezoelectric element 35. Further, a wiring cavity 38 is formed in the protective substrate 24 at a position between the adjacent rows of the piezoelectric elements so as to penetrate the substrate in the thickness direction. An electrode terminal of the piezoelectric element 35 and one end of the flexible cable 49 are positioned in the wiring cavity 38.

At least a dimension W1 of the pressure generating unit 14 in the second direction is defined to be smaller than a dimension W2 of the communication substrate 23 in the same direction and a dimension W3 of the case head 26 in the same direction.

The nozzle plate 22 is a plate member having a plurality of nozzles 27 arranged in rows at a pitch corresponding to the dot forming density. In this embodiment, the nozzle rows (a type of a group of nozzles) are composed of 360 nozzles 27 that are arranged at a pitch of 360 dpi. In this embodiment, two rows of nozzles 27 are formed on the nozzle plate 22. Although the nozzle plate 22 may be made of a material such as a ceramic and a metal, the nozzle plate 22 of this embodiment is made of a silicon substrate. The cylindrical nozzles 27 are formed on the substrate by performing dry etching. The nozzles 27 can be formed by dry etching with higher accuracy compared to, for example, those formed by plastic working on a metal plate such as a stainless steel. Accordingly, the ejection accuracy of ink ejected from the nozzles 27 can be improved.

At least a dimension W4 of the nozzle plate 22 in a direction perpendicular to the nozzle row (second direction) is defined to be smaller than the dimension W1 of the pressure generating unit 14 in the same direction, the dimension W2 of the communication substrate 23 in the same direction and the dimension W3 of the case head 26 in the same direction. Specifically, the dimension W4 is defined to be as small as possible within the limit that liquid-tight sealing between the nozzle communication path 36 and the nozzle 27 can be reliably achieved (that is, a bonding margin that allows the nozzle communication path 36 and the nozzle 27 to communicate with each other in a liquid-tight manner), as will be described later. Accordingly, minimization of the nozzle plate 22 can contribute to cost reduction. When the communication substrate 23 and the nozzle plate 22 are bonded to each other with the nozzle communication path 36 and the nozzle 27 being aligned to communicate with each other, the liquid chamber cavity 33 (33*a*, 33*b*) is not covered by the nozzle plate 22.

Figure 5A:
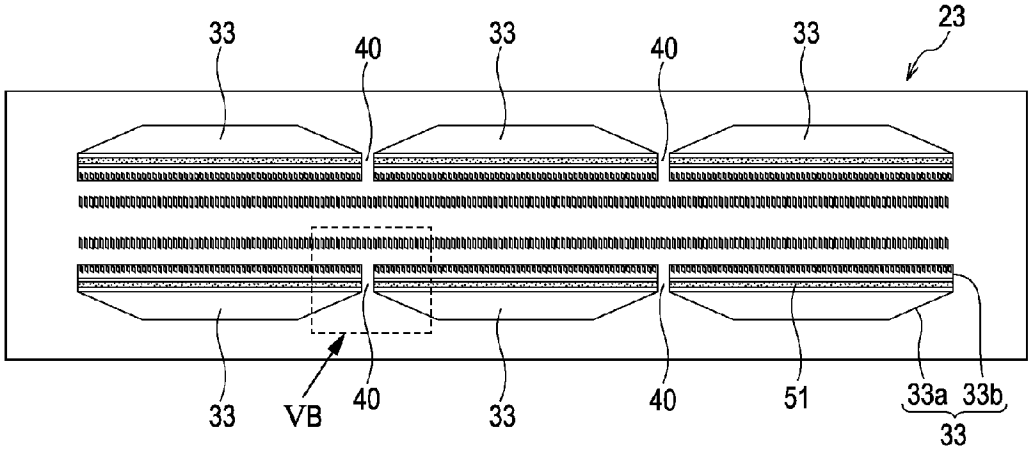
FIGS. 5A and 5B are bottom views of a communication substrate.
Figure 5B:
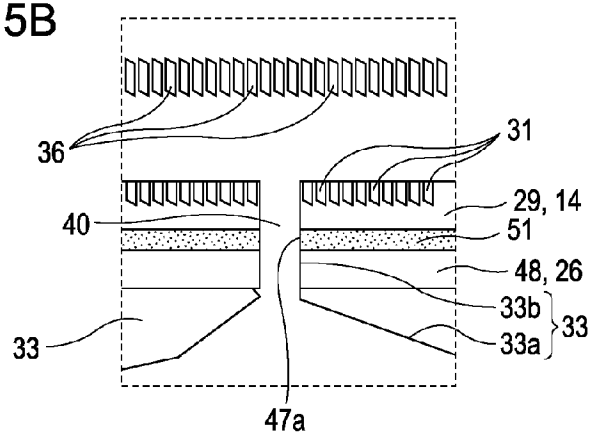

FIGS. 5A and 5B are views which explain a configuration of the communication substrate 23 (in the state that the case head 26 and the pressure generating unit 14 are bonded to each other). FIG. 5A is a plan view as viewed from the surface (the underside) on which the nozzle plate 22 and the compliance sheet 25 are bonded, and FIG. 5B is an enlarged view of an area VB of FIG. 5A. An opening of the pressure chamber 31 on the side of the flow path forming substrate and an adhesive 51 are exposed through the opening 33*b* of the communication substrate 23. The communication substrate 23 is a plate member made of a silicon substrate. The liquid chamber cavity 33 that forms part of the common liquid chamber 32 is formed by anisotropic etching the communication substrate 23 to penetrate in the thickness direction. A plurality of (in this embodiment, three) liquid chamber cavities 33 are provided for one row of nozzles 27 in the nozzle row direction (first direction) on the communication substrate 23. Accordingly, different types of ink can be assigned to one row of nozzles 27. Since two rows of nozzles 27 are formed on the nozzle plate in this embodiment, six liquid chamber cavities 33 are formed on the communication substrate 23. The adjacent liquid chamber cavities 33 are separated by a partition wall 40 and independent from each other. That is, three liquid chamber cavities 33 are formed in the first direction with being divided by the partition walls 40.

The liquid chamber cavity 33 is composed of the first communication section 33*a* that communicates with a liquid chamber forming cavity 46 (which will be described later) of the case head 26 and the second communication section 33*b* that communicates the first communication section 33*a* with the pressure chamber 31. The first communication section 33*a* and the second communication section 33*b* correspond to the first liquid chamber, and the liquid chamber forming cavity 46 corresponds to the second liquid chamber. The first communication section 33*a* is a cavity that has an opening having the shape and dimension of an opening on the bottom side of the liquid chamber forming cavity 46 (which will be described later) of the case head 26. The second communication section 33*b* is a cavity that has an opening of a rectangular shape in plan view and is formed at a position adjacent to and inner side with respect to the first communication section 33*a* in the second direction (close to the center). As shown in FIG. 5A, the second communication section 33*b* extends in the first direction along the first communication section 33*a* from one end to the other end of the first communication section 33*a*. Further, as shown in FIG. 5B, the second communication section 33*b* extends in the second direction from the first communication section 33*a* (that is, a position to communicate with the liquid chamber forming cavity 46) to the underside (the side of the nozzle plate 22) of a dividing wall 48 (which will be described later) of the case head 26 and the underside of the other end of the pressure chamber 31 through the underside of a gap 47*a* of a housing cavity 47 between the dividing wall 48 and the pressure generating unit 14. That is, one end of the second communication section 33*b* in the second direction communicates with the first communication section 33*a*, while the other end of the second communication section 33*b* in the same direction is formed at a position that communicates with the pressure chamber 31 of the pressure chamber forming substrate 29 that is bonded to the communication substrate 23. Accordingly, the opening of the second communication section 33*b* faces part of the dividing wall 48, part of the gap 47*a*, and part (the other end) of the pressure chamber 31. As shown in FIG. 5B, when the communication substrate 23 is bonded to the case head 26 and the pressure generating unit 14, part of the opening of the gap 47*a* of the housing cavity which is formed between the dividing wall 48 and the pressure generating unit 14 faces the opening of the second communication section 33*b* (liquid chamber cavity 33). This opening of the gap 47*a* is sealed by being completely filled with the adhesive 51.

The liquid chamber cavity 33, that is, the first communication section 33*a* and the second communication section 33*b* face the underside of the protective substrate 24 at a position outer side with respect to the connection with the nozzle plate 22 in the second direction. The opening of the liquid chamber cavity 33 is sealed by the compliance sheet 25. The compliance sheet 25 is a thin sheet material made of a synthetic resin or a metal having flexibility. The compliance sheet 25 serves as a compliance section that absorbs pressure changes of ink in the common liquid chamber 32.

Figure 6:
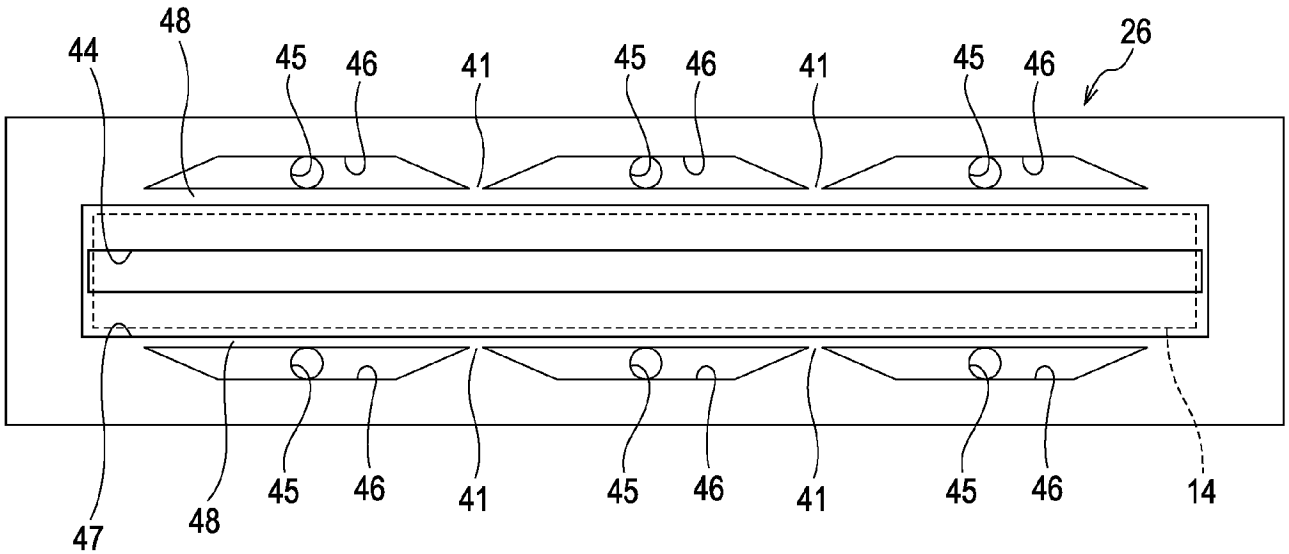
FIG. 6 is a bottom view of a case head.
Figure 7A:
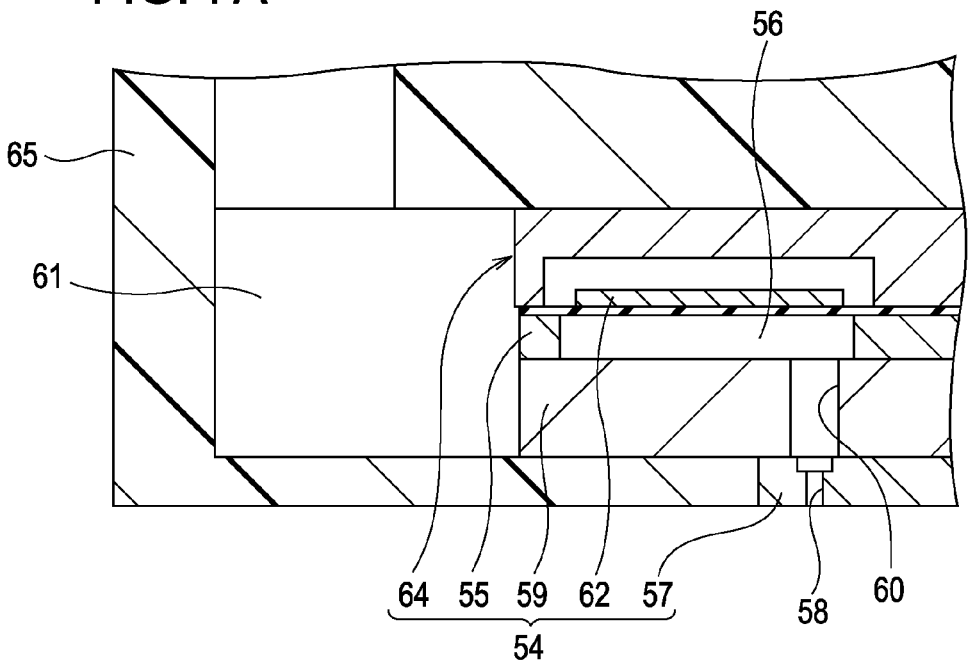
FIGS. 7A and 7B are schematic views which show an example of a configuration of a conventional liquid ejection head.
Figure 7B:
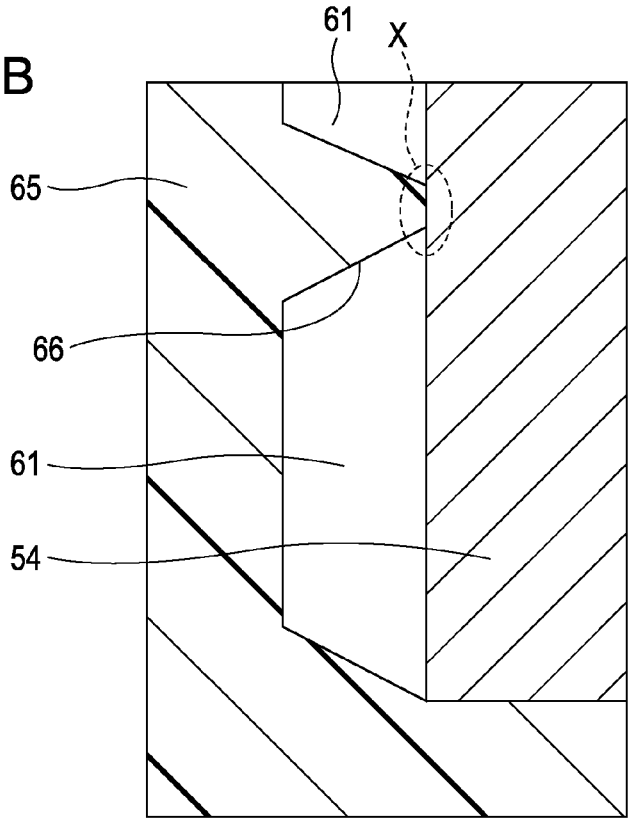

FIG. 6 is a plan view of the underside of the case head 26 (the surface on which the communication substrate 23 of the flow path unit 21 is bonded). The case head 26 is a box-shaped member made of a synthetic resin that is fixedly attached to the bottom side of the communication substrate 23 on which the nozzle plate 22, the compliance sheet 25 and the pressure generating unit 14 is bonded. A through cavity 44 that has an elongated rectangular opening that extends in the nozzle row direction is formed at the center of the case head 26 in plan view so as to penetrate the case head 26 in the height direction. The through cavity 44 forms a cavity that communicates with the wiring cavity 38 of the pressure generating unit 14 and houses one end of the flexible cable 49 and the drive IC. The housing cavity 47 is formed on the underside of the case head 26 so as to extend from the underside to a position midway in the height direction of the case head 26. The depth of the housing cavity 47 is defined to be slightly larger than the thickness (height) of the pressure generating unit 14. Further, the dimensions of the housing cavity 47 in the first direction and the second direction are defined to be slightly larger than the dimensions of the pressure generating unit 14 in the corresponding directions. When the flow path unit 21 is positioned and bonded on the underside of the case head 26, the pressure generating unit 14 that is stacked on the communication substrate 23 is housed in the housing cavity 47. Further, the lower end of the through cavity 44 is open to the top face of the housing cavity 47.

In the case head 26, the liquid chamber forming cavities 46 and the ink introduction paths 45 are formed. The liquid chamber forming cavities 46 are formed on outer side with respect to the housing cavity 47 of the case head in the second direction with the dividing wall 48 therebetween. More specifically, six liquid chamber forming cavities 46 are formed on each side of the housing cavity 47 so as to correspond to the liquid chamber cavities 33 of the communication substrate 23. The adjacent liquid chamber forming cavities 46 are separated by a partition section 41 and independent from each other. That is, three liquid chamber forming cavities 46 are formed in the first direction with being divided by the partition sections 41. When the communication substrate 23 is bonded to the case head 26, each liquid chamber forming cavity 46 communicates with the corresponding liquid chamber cavity 33 and forms the common liquid chamber 32. The ink introduction path 45 is a flow path provided for each liquid chamber forming cavity 46 with one end of which is open to the top face of the case head 26 and the other end is open to the corresponding liquid chamber forming cavity 46. Accordingly, ink is introduced from the ink cartridge 7 to the liquid chamber forming cavity 46 (common liquid chamber 32) through the ink introduction path 45.

In manufacturing the head unit 16 having above-mentioned configuration, the elastic film 30 and the insulation film are formed in sequence on the top face of the pressure chamber forming substrate 29 (the silicon substrate on which the pressure chambers 31 are not formed), and then the piezoelectric elements 35 are formed by baking. Then, the protective substrate 24 is provided such that the piezoelectric element 35 is housed in the relief recess 39. After that, the pressure chamber 31 is formed from the underside of the pressure chamber forming substrate 29 by anisotropic etching. Accordingly, the pressure chamber forming substrate 29 is prevented from being broken during assembling of the pressure generating unit 14, since the piezoelectric elements 35 and the protective substrate 24 are stacked and unitized on the top face of the pressure chamber forming substrate 29 before the pressure chamber 31 is formed on the pressure chamber forming substrate 29.

Next, the nozzle plate 22 is bonded to the underside of the communication substrate 23 by using an adhesive while the nozzle communication paths 36 communicate with the nozzles 27. Further, the compliance sheet 25 is bonded to the underside of the communication substrate 23 so as to seal the opening of the liquid chamber cavity 33. Thus, the flow path unit 21 is unitized. The pressure generating unit 14 is then bonded to the top face of the communication substrate 23 of the flow path unit 21. Specifically, the pressure chamber forming substrate 29 is bonded to the top face of the flow path substrate 23 of the pressure generating unit 14 by using an adhesive while one end of the pressure chamber 31 in the second direction communicates with the nozzle communication path 36 and the other end of the pressure chamber 31 in the second direction communicates with the individual communication path 42 of the second communication section 33*b*.

After the flow path unit 21 and the pressure generating unit 14 are assembled, wiring of the flexible cable 49 to the electrode terminal of the respective piezoelectric elements 35 is carried out through the wiring cavity of the protective substrate 24. That is, the portion of the respective piezoelectric elements 35 which corresponds to the electrode terminal is electrically connected to the terminal of one end of the flexible cable 49.

Then, the communication substrate 23 of the flow path unit 21 and the case head 26 are bonded by using an adhesive. Specifically, the top face of the communication substrate 23 and the underside of the case head 26 are bonded by using an adhesive. When the flow path unit 21 and the case head 26 are bonded, the pressure generating unit 14 is housed in the housing cavity 47 while the liquid chamber forming cavity 46 and the liquid chamber cavity 33 communicate with each other in a liquid-tight manner such that a plurality of (in this embodiment, six) common liquid chambers 32 are formed as cavities independent from each other. Further, one end of the flexible cable 49 and the drive IC 50 is housed in the through cavity 44 of the case head 26. Thus, the head unit 16 is assembled. Moreover, a series of the common flow path that extends from the ink introduction path 45 through the common liquid chamber 32 to the second communication section 33*b* and the individual flow path that extends from the pressure chamber 31 through the nozzle communication path 36 to the nozzle 27 are formed in the head unit 16.

After that, the gap between the housing cavity 47 of the case head 26 and the pressure generating unit 14 is filled with the adhesive 51 having a low viscosity. The adhesive 51 advantageously includes, for example, silicone adhesive and epoxy adhesive. For example, as shown in FIG. 4, the adhesive 51 is introduced from a position of the opening of the through cavity 44 which is indicated by A of the gap between the housing cavity 47 and the pressure generating unit 14, and fills the gap up to an opening B on the side of the second communication section 33*b* by using capillary force. Accordingly, the opening of the gap 47*a* that faces the opening of the liquid chamber cavity 33 is sealed by the adhesive 51. As a result, ink is prevented from being flowing into the housing cavity 47 from the liquid chamber cavity 33. When the pressure generating unit 14 are downsized in the configuration in which a plurality of common liquid chambers 32 are provided for one row of nozzles 27 in the nozzle row direction, it is possible to form a plurality of common liquid chambers 32 independent from each other only by bonding the top face of the communication substrate 23 that includes the partition wall 40 and the underside of the case head 26 without bonding the side face of the wall that separates the common liquid chamber 32 adjacent in the first direction to the side face of the pressure generating unit 14. Accordingly, in the configuration in which a plurality of common liquid chambers 32 are provided for one row of nozzles 27 in the nozzle row direction, it is also possible to downsize the pressure generating unit 14, especially the pressure chamber forming substrate 29 made of a silicon substrate, while preventing liquid from being leaked from a position between the common liquid chambers 32, thereby reducing the cost of the entire head unit 16. In addition, the adhesive 51 does not necessarily fill the entire gap between the housing cavity 47 and the pressure generating unit 14, and may only seal the opening of the gap 47*a* that faces the opening of the second communication section 33*b*.

The invention is not limited to the above embodiment and various modifications can be made within the description of claims.

For example, although the above embodiment has been described as having the configuration in which the compliance sheet 25 on the underside of the nozzle plate 22 serves as a compliance section that absorbs pressure changes in the common liquid chamber 32, the invention is not limited thereto. The compliance section may be provided at any position that is capable of absorbing pressure changes of the common liquid chamber 32, for example, at a position adjacent to the liquid chamber forming cavity 46 of the case head 26. In this case, the configuration is possible in which the liquid chamber cavity 33 and the second communication section 33*b* of the communication substrate 23 are not open to the underside of the communication substrate (the liquid chamber cavity 33 and the second communication section 33*b* of the communication substrate 23 are formed to extend from the top side to a position midway in the thickness direction of the communication substrate 23). Alternatively, the configuration may also be possible in which the liquid chamber cavity 33 and the second communication section 33*b* of the communication substrate 23 are open to the underside of the communication substrate 23 and the opening is sealed by the nozzle plate 22. In this configuration, the nozzle plate 22 has dimensions that are capable of substantially covering the entire underside of the communication substrate 23.

Although the ink jet recording head 3 (head unit 16) which is a type of liquid ejection head has been described as an example, the invention can be applied to other liquid ejection heads having a configuration in which the pressure generating unit and the flow path unit are fixedly attached to the case head. For example, the invention can be applied to color material ejection heads used for manufacturing of color filters for liquid crystal displays and the like, electrode material ejection heads used for manufacturing of organic electroluminescence (EL) displays, field emission displays (FEDs) and the like, and bio-organic material ejection heads used for manufacturing of bio-chips (biochemical elements).

What is claimed is:

1. A liquid ejection head comprising: a nozzle forming member having a group of nozzles composed of a plurality of nozzles that are arranged in rows in a first direction; a pressure generating unit having a pressure chamber forming substrate in which a plurality of pressure chambers that correspond to the plurality of nozzles are formed, a plurality of pressure generating sections that are formed to correspond to the pressure chambers, and a protective substrate that is connected to the pressure chamber forming substrate with the pressure generating sections being housed therein; a communication plate in which a first liquid chamber that communicate with the plurality of pressure chambers is formed; and a case member to which the pressure generating unit and the communication plate are fixedly attached, wherein a plurality of the first liquid chambers separated from each other are provided in the first direction and the first liquid chamber communicates with the pressure chamber through an opening in the thickness direction of the communication plate; and a gap between the case member and the pressure generating unit is sealed with an adhesive and the opening of the first liquid chamber on the side of the case member is sealed by using the adhesive.

2. The liquid ejection head according to claim 1, wherein the case member has a housing cavity that houses the pressure generating unit and a second liquid chamber that communicates with the first liquid chamber, an opening of the first liquid chamber on the side of the case member faces part of the case member and part of the pressure chamber of the pressure generating unit, and the case member and the pressure generating unit at the housing cavity are at least partially bonded to each other.

3. A liquid ejection apparatus comprising the liquid ejection head according to claim 1.

* * * * *